US009217940B2

(12) United States Patent
Kikushima

(10) Patent No.: US 9,217,940 B2
(45) Date of Patent: Dec. 22, 2015

(54) METHOD FOR PRODUCING TONER

(71) Applicant: KYOCERA Document Solutions Inc., Osaka (JP)

(72) Inventor: Seiji Kikushima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/483,476

(22) Filed: Sep. 11, 2014

(65) Prior Publication Data

US 2015/0079517 A1 Mar. 19, 2015

(30) Foreign Application Priority Data

Sep. 13, 2013 (JP) ..... 2013-190043

(51) Int. Cl.
*G03G 9/093* (2006.01)
*G03G 9/08* (2006.01)

(52) U.S. Cl.
CPC ..... *G03G 9/0804* (2013.01); *G03G 9/09314* (2013.01); *G03G 9/09328* (2013.01); *G03G 9/09392* (2013.01)

(58) Field of Classification Search
CPC . G03G 9/0802; G03G 9/081; G03G 9/09307; G03G 9/09357
See application file for complete search history.

(56) References Cited

U.S. PATENT DOCUMENTS 4,761,358 A 8/1988 Hosoi et al.
5,529,877 A 6/1996 Inaba et al.

FOREIGN PATENT DOCUMENTS

GB 2178182 A 2/1987
JP H07-333887 A 12/1995

OTHER PUBLICATIONS

The extended European search report issued by the European Patent Office on Jan. 27, 2015, which corresponds to European Patent Application No. 14184231.0-1303 and is related to U.S. Appl. No. 14/483,476.

*Primary Examiner* — Hoa V Le
(74) *Attorney, Agent, or Firm* — Studebaker & Brackett PC

(57) ABSTRACT

A method for producing a toner includes: dissolving a thermoplastic resin and a thermosetting resin in an organic solvent; mixing the organic solvent containing the thermoplastic resin and the thermosetting resin with an aqueous medium, and micronizing the thermoplastic resin in a mixture obtained; and forming a film of the dissolved thermosetting resin on surfaces of fine particles formed through the micronization.

10 Claims, 2 Drawing Sheets

METHOD FOR PRODUCING TONER

INCORPORATION BY REFERENCE

The present application claims priority under 35 U.S.C. §119 to Japanese Patent Application No. 2013-190043, filed Sep. 13, 2013. The contents of this application are incorporated herein by reference in their entirety.

BACKGROUND

The present disclosure relates to methods for producing a toner. More particularly, the present disclosure relates to a method for producing a capsule toner.

A capsule toner is composed of a core and a shell layer (capsule layer) formed on a surface of the core.

For example, a method for producing a toner has been proposed, including preliminary mixing and dispersing toner particles and fine particles (inorganic or organic) in a solvent, adding thereto a curing resin precursor, and forming a cured film (curing resin and fine particles) on surfaces of the toner particles.

SUMMARY

A method for producing a toner according to the present disclosure includes: dissolving a thermoplastic resin and a thermosetting resin in an organic solvent; mixing the organic solvent containing the thermoplastic resin and the thermosetting resin with an aqueous medium, and micronizing the thermoplastic resin in a mixture obtained; and forming a film of the dissolved thermosetting resin on surfaces of fine particles formed through the micronization.

DETAILED DESCRIPTION

Hereinafter, an embodiment of the present disclosure will be described.

A toner according to the present embodiment is a capsule toner for development of an electrostatic charge image. The toner of the present embodiment is a powder composed of a plurality of particles (hereinafter, referred to as toner particles). The toner according to the present embodiment can be used in an electrophotographic apparatus (image forming apparatus), for example.

The electrophotographic apparatus develops an electrostatic charge image with a developer containing a toner. Specifically, the toner from a developing device is attached to an electrostatic latent image formed on a photosensitive member. Then, the toner attached is transferred to a recording medium (e.g., paper), and subsequently fixed to the recording medium with heat. Thus, an image is formed on the recording medium. For example, a full color image can be formed by superimposing toner images in four colors of black, yellow, magenta, and cyan.

Figure 1:
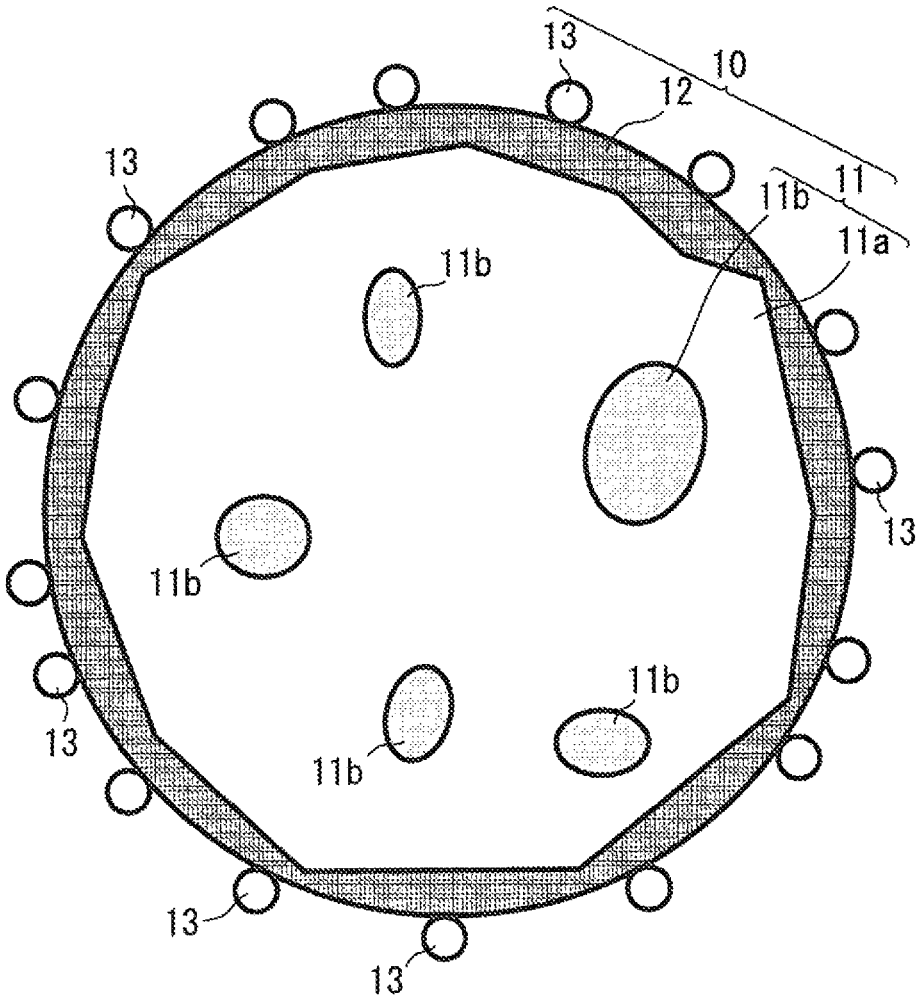
FIG. 1 is a cross sectional view schematically showing a structure of a toner particle for forming a toner according to an embodiment of the present disclosure.

Hereinafter, a structure of the toner (in particular, toner particles) according to the present embodiment will be described with reference to FIG. 1. FIG. 1 is a cross sectional view schematically showing a structure of a toner particle 10 for forming the toner of the present embodiment.

As shown in FIG. 1, the toner particle 10 has a core 11, a shell layer 12 (capsule layer) formed on a surface of the core 11, and an external additive 13.

The core 11 has a binder resin 11*a* and an internal additive 11*b* (e.g., a colorant or a mold releasing agent). The core 11 is coated with the shell layer 12. The external additive 13 is attached to the surface of the shell layer 12. Hereinafter, particles yet to be externally treated with an additive (the toner particle 10 without the external additive 13) will be referred to as "toner mother particles".

Preferably, the core 11 is anionic, and the material of the shell layer 12 is cationic. With the anionic core 11, the cationic shell material (the material of the shell layer 12) can be attracted by the surface of the core 11 in the formation of the shell layer 12. Specifically, it is considered that the shell material positively charged in an aqueous medium is electrically attracted by the core 11 negatively charged in the aqueous medium, for example, and the shell layer 12 is formed on the surface of the core 11 through an in-situ polymerization, for example. It is supposed that the shell layer 12 can be formed uniformly on the surface of the core 11 more readily without highly dispersing the core 11 in the aqueous medium using a dispersant since the core 11 attracts the material of the shell layer 12.

However, the toner particle is not limited to the above-described structure. For example, the internal additive 11*b* or the external additive 13 may be omitted if unnecessary. The toner particle may have a plurality of shell layers 12 on the surface of the core 11. Preferably, in the case of the toner particle having stacked shell layers 12, the outermost shell layer 12 of the shell layers 12 is cationic.

A zeta-potential of the core 11 of a negative polarity (lower than 0 V) as measured in an aqueous medium adjusted to pH4 (hereinafter, referred to as zeta-potential at pH 4) is an indication of the core 11 being anionic. Preferably, the zeta-potential of the core 11 at pH 4 is lower than 0 V, and the zeta-potential of the toner particle 10 at pH 4 is higher than 0 V in order to strengthen the bond between the core 11 and the shell layer 12. In the present embodiment, the shell layer 12 is formed at pH 4.

Examples of a method for measuring the zeta-potential include electrophoresis, ultrasound, and electroacoustic sonic amplitude (ESA) methods.

The electrophoresis is to apply an electric field to a particle dispersion to electrophorese charged particles in the dispersion and calculate the zeta-potential based on the electrophoretic velocity. Examples of the electrophoresis include the laser Doppler method (method including irradiating electrophoresed particles with laser light and determining the electrophoretic velocity based on the Doppler shift of the scattered light obtained). The laser Doppler method is advantageous in that the particle concentration of the dispersion need not be high, that fewer parameters are needed for calculating the zeta-potential, and that the electrophoretic velocity can be sensitively detected.

The ultrasound method is to apply an ultrasound wave to a particle dispersion to oscillate charged particles in the dispersion and calculate the zeta-potential based on the potential difference generated because of the oscillation.

In the ESA method, a high-frequency voltage is applied to a dispersion of particles to oscillate charged particles in the dispersion, thereby generating an ultrasound wave. Then, the zeta-potential is calculated based on the magnitude (strength) of the ultrasound wave.

Both the ultrasound method and the ESA method are advantageous in that the zeta-potential can be sensitively measured even if the dispersion of the particles has a high particle concentration (e.g., higher than 20% by mass).

Preferably, a dispersant (surfactant) is not used in the production of the toner. In the toner produced without using a dispersant, both the core 11 and the shell layer 12 are assumed to have no dispersant. Generally, a dispersant have high effluent load. Without a dispersant, it is possible to hold the total organic carbon (TOC) concentration in effluent to be released in the production of the toner particle 10 to a level as low as 15 mg/L or lower without diluting the effluent.

The amount of organic components in the effluent (e.g., unreacted monomers, prepolymer, or dispersant) can be measured by measuring the biochemical oxygen demand (BOD), the chemical oxygen demand (COD), or the total organic carbon (TOC) concentration. In particular, organic substances can be generally measured in a stable manner by measuring the TOC concentration. In addition, the amount of organic components having failed to contribute to encapsulation in the effluent (total of the filtrate and the wash fluid after reaction) can be specified by measuring the TOC concentration.

Hereinafter, the core 11 (the binder resin 11*a* and the internal additive 11*b*), the shell layer 12, and the external additive 13 will be described in sequence. It should be noted that acrylic acid and methacrylic acid may be collectively referred to as "(meth)acrylic acid".

[Core]

The core 11 for forming the toner particle 10 contains the binder resin 11*a*. The core 11 may further contain the internal additive 11*b* (e.g., a colorant and a mold releasing agent). An unnecessary component (e.g., a colorant or a mold releasing agent) may be omitted depending on the use of the toner. The core 11 may further contain a charge control agent.

[Binder Resin (for Core)]

In many cases, the binder resin 11*a* accounts for most (e.g., 85% by mass or more) of the components of the core 11. Accordingly, the polarity of the binder resin 11*a* is considered to have a great impact on the polarity of the entire core 11. For example, when the binder resin 11*a* has an ester group, a hydroxyl group, an ether group, an acid group, or a methyl group, the core 11 is likely to be anionic. When the binder resin 11*a* has an amino group, an amine, or an amide group, the core 11 is likely to be cationic.

Preferably, the binder resin 11*a* has a glass transition point (Tg) equal to or lower than the cure onset temperature of a thermosetting resin contained in the shell layer 12. It is considered that use of the binder resin 11*a* having such a Tg can reduce the possibility of poor fixability of the toner in high speed fixing. Most thermosetting resins (in particular, melamine-based resins) have a cure onset temperature of approximately 55° C. The binder resin 11*a* has a Tg of preferably 20° C. or higher, more preferably 30° C. or higher and 55° C. or lower, and still more preferably 30° C. or higher and 50° C. or loser. When the binder resin 11*a* has a Tg of 20° C. or higher, the core 11 is less likely to aggregate in the formation of the shell layer 12.

The glass transition point (Tg) of the binder resin 11*a* can be measured by the following method. First, a heat absorption curve of the binder resin 11*a* is obtained using a differential scanning calorimeter (DSC) (e.g., "DSC-6200", product by Seiko Instruments Inc.) Then, the glass transition point (Tg) of the binder resin 11*a* is determined based on the heat absorption curve obtained (specifically, based on a changing point of the specific heat of the binder resin 11*a*). For example, 10 mg of the binder resin 11*a* (measurement sample) is placed in an aluminum pan, and the heat absorption curve of the binder resin 11*a* is obtained with an empty aluminum pan as a reference in a measurement temperature range of 25° C. to 200° C. at a heating rate of 10° C./minute. Then, the glass transition point (Tg) of the binder resin 11*a* is determined based on the heat absorption curve of the binder resin 11*a* obtained.

The binder resin 11*a* has a softening point (Tm) of preferably 100° C. or lower, and more preferably 80° C. or lower. Use of the binder resin 11*a* having a Tm of 100° C. or lower (more preferably 80° C. or lower) can reduce the possibility of poor fixability of the toner in high speed fixing. The Tm of the binder resin 11*a* can be adjusted by combining a plurality of binder resins having different Tms.

Figure 2:
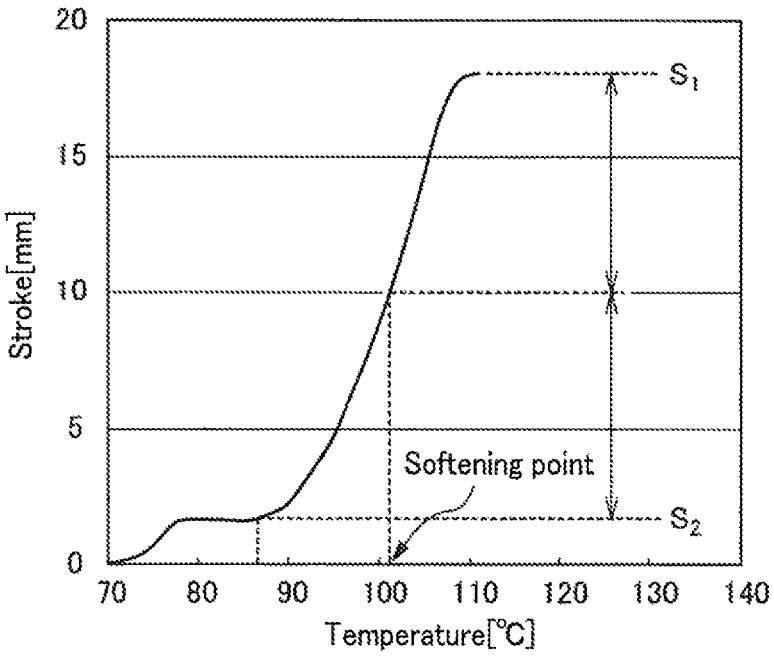
FIG. 2 is a graphic representation for illustrating how to read a softening point from an S-shaped curve.

The softening point (Tm) of the binder resin 11*a* can be measured by the following method. The softening point (Tm) of the binder resin 11*a* can be measured using an elevated type flow tester (e.g., "CFT-500D", product by Shimadzu Corporation). For example, the binder resin 11*a* (measurement sample) is set in the elevated type flow tester, and the sample having a volume of 1 $cm^3$ is allowed to melt-flow through die pores having a size of 1 mm at a plunger load of 20 $kg/cm^2$ and a heating rate of 6° C./minute. Thus, an S-shaped curve relating temperature (° C.) to stroke (mm) can be obtained. Then, the Tm of the binder resin 11*a* can be read from the S-shaped curve obtained. FIG. 2 is a graph showing an example of the S-shaped curve. In FIG. 2, $S_1$ represents a maximum stroke value, and $S_2$ represents a baseline stroke value at a low temperature side. A temperature at which the stroke value in the S-shaped curve is $(S_1+S_2)/2$ corresponds to the Tm of the measurement sample.

The description of the binder resin 11*a* shown in FIG. 1 will be continued. Preferably, the binder resin 11*a* is a resin having a functional group such as an ester group, a hydroxyl group, an ether group, an acid group, a methyl group, or a carboxyl group in the molecule. More preferably, the binder resin 11*a* is a resin having hydroxyl groups and/or carboxyl groups in the molecule. The core 11 (binder resin 11*a*) having such a functional group is likely to react with and chemically bind to the material of the shell layer 12 (e.g., methylolmelamine). Such chemical binding strengthens the bond between the core 11 and the shell layer 12.

Preferably, the binder resin 11*a* is a thermoplastic resin. Suitable examples of the thermoplastic resin to be used as the binder resin 11*a* include styrene-based resins, acrylic-based resins, styrene-acrylic-based resins, polyethylene-based resins, polypropylene-based resins, vinyl chloride-based resins, polyester resins, polyamide-based resins, polyurethane-based resins, polyvinyl alcohol-based resins, vinyl ether-based resins, N-vinyl-based resins, and styrene-butadiene-based resins. In particular, the styrene-acrylic-based resins and the polyester resins can provide excellent colorant dispersibility in the toner, excellent chargeability of the toner, and excellent fixability of the toner to a recording medium.

(Styrene-Acrylic-Based Resin)

A styrene-acrylic-based resin is a copolymer of a styrene-based monomer and an acrylic-based monomer.

Suitable examples of the styrene-based monomer to be used for the preparation of the styrene-acrylic-based resin (binder resin 11*a*) include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Suitable examples of the acrylic-based monomer to be used for the preparation of the styrene-acrylic-based resin (binder resin 11*a*) include (meth)acrylic acid, alkyl (meth) acrylates, and hydroxyalkyl (meth)acrylates. Suitable examples of the alkyl (meth)acrylates include methyl (meth) acrylate, ethyl (meth)acrylate, n-propyl (meth)acrylate, isopropyl (meth)acrylate, n-butyl (meth)acrylate, iso-butyl (meth)acrylate, and 2-ethylhexyl (meth)acrylate. Suitable examples of the hydroxyalkyl (meth)acrylates include 2-hydroxyethyl(meth)acrylate, 3-hydroxypropyl(meth)acrylate, 2-hydroxypropyl(meth)acrylate, and 4-hydroxypropyl (meth)acrylate.

Hydroxyl groups can be introduced into the styrene-acrylic-based resin by using a monomer having a hydroxyl group (e.g., p-hydroxystyrene, m-hydroxystyrene, or hydroxyalkyl (meth)acrylate for the preparation of the styrene-acrylic-based resin. The hydroxyl value of the styrene-acrylic-based resin to be obtained can be adjusted by appropriately adjusting the amount of the monomer having a hydroxyl group.

Use of the (meth)acrylic acid (monomer) in the preparation of the styrene-acrylic-based resin allows introduction of carboxyl groups into the styrene-acrylic-based resin. The acid value of the styrene-acrylic-based resin to be obtained can be adjusted by appropriately adjusting the amount of the (meth) acrylic acid.

When the binder resin 11*a* is a styrene-acrylic-based resin, the styrene-acrylic-based resin preferably has a number average molecular weight (Mn) of 2000 or more and 3000 or less in order to enhance the strength of the core 11 and the fixability of the toner. Preferably, the styrene-acrylic-based resin has a molecular weight distribution (Mw/Mn: ratio of the weight average molecular weight (Mw) to the number average molecular weight (Mn)) of 10 or more and 20 or less. The Mn and the Mw of the styrene-acrylic-based resin can be measured by gel permeation chromatography.

(Polyester Resin)

The polyester resin to be used as the binder resin 11*a* can be obtained through condensation polymerization or condensation copolymerization of a dihydric, or tri- or higher-hydric alcohol with a dibasic, or tri- or higher-basic carboxylic acid.

When the binder resin 11*a* is a polyester resin, suitable examples of the alcohol to be used for the preparation of the polyester resin include diols, bisphenols, and tri- or higher-hydric alcohols.

Specific examples of the diols include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Specific examples of the bisphenols include bisphenol A, hydrogenated bisphenol A, polyoxyethylenated bisphenol A, and polyoxypropylenated bisphenol A.

Specific examples of the tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

When the binder resin 11*a* is a polyester resin, suitable examples of the carboxylic acid to be used for the preparation of the polyester resin include a dibasic, or tri- or higher-basic carboxylic acid.

Specific examples of the dibasic carboxylic acid include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acid (more specifically, n-butylsuccinic acid, isobutylsuccinic acid, n-octylsuccinic acid, n-dodecylsuccinic acid, or isododecylsuccinic acid), and alkenyl succinic acid (more specifically, n-butenylsuccinic acid, isobutenylsuccinic acid, n-octenylsuccinic acid, n-dodecenylsuccinic acid, or isododecenylsuccinic acid).

Specific examples of the tri- or higher-basic carboxylic acid include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, and Empol trimer acid.

These dibasic, or tri- or higher-basic carboxylic acids may be used in the form of ester-forming derivatives (acid halides, acid anhydrides, or lower alkyl esters). The term "lower alkyl" used herein refers to an alkyl group having 1 to 6 carbon atoms.

The acid value and the hydroxyl value of the polyester resin can be adjusted by appropriately adjusting the amount of dihydric, or tri- or higher-hydric alcohol and the amount of dibasic, or tri- or higher-basic carboxylic acid, respectively, in the preparation of the polyester resin. The acid value and the hydroxyl value of the polyester resin tend to decrease with increase in the molecular weight of the polyester resin.

When the binder resin 11*a* is a polyester resin, the polyester resin preferably has a number average molecular weight (Mn) of 1200 or more and 2000 or less in order to enhance the strength of the core 11 and the fixability of the toner. Preferably, the polyester resin has a molecular weight distribution (Mw/Mn: ratio of the weight average molecular weight (Mw) to the number average molecular weight (Mn)) of 9 or more and 20 or less. The Mn and the Mw of the polyester resin can be measured by gel permeation chromatography.

[Colorant (for Core)]

The core 11 may contain a colorant as needed. As the colorant, a known pigment or dye may be used depending on the color of the toner. The amount of the colorant is preferably 1 part by mass or more and 20 parts by mass or less, and more preferably 3 parts by mass or more and 10 parts by mass or less with respect to 100 parts by mass of the binder resin 11*a*.

(Black Colorant)

The core 11 may contain a black colorant. Examples of the black colorant include carbon black. The black colorant may be a colorant whose color is adjusted to black using a yellow colorant, a magenta colorant, and a cyan colorant.

(Color Colorant)

The core 11 may contain a color colorant such as a yellow colorant, a magenta colorant, or a cyan colorant.

Examples of the yellow colorant include condensed azo compounds, isoindolinone compounds, anthraquinone compounds, azo metal complexes, methine compounds, and allylamide compounds. Suitable examples of the yellow colorant include C.I. pigment yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), naphthol yellow S, Hansa yellow G, and C.I. Vat yellow.

Examples of the magenta colorant include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Suitable examples of the magenta colorant include C.I. pigment red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

Examples of the cyan colorant include copper phthalocyanine compounds, copper phthalocyanine derivatives, anthraquinone compounds, and basic dye lake compounds. Suitable examples of the cyan colorant include C.I. pigment blue (1, 7, 15, 15:1, 15:2, 15:3, 15:4, 60, 62, or 66), phthalocyanine blue, C.I. Vat blue, and C.I. acid blue.

[Mold Releasing Agent (for Core)]

The core 11 may contain a mold releasing agent as needed. The mold releasing agent is used for the purpose of enhancing the fixability or the offset resistance of the toner. In order to enhance the fixability or the offset resistance of the toner, the amount of the mold releasing agent is preferably 1 part by mass or more and 30 parts by mass or less, and more preferably 5 parts by mass or more and 20 parts by mass or less with respect to 100 parts by mass of the binder resin 11*a*.

Examples of the mold releasing agent include aliphatic hydrocarbon waxes such as low molecular weight polyethylenes, low molecular weight polypropylenes, polyolefin copolymers, polyolefin waxes, microcrystalline waxes, paraffin waxes, and Fischer-Tropsch waxes; oxides of aliphatic hydrocarbon waxes such as oxidized polyethylene waxes, and block copolymers of oxidized polyethylene waxes; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes containing a fatty acid ester as a major component such as montanic acid ester wax, and castor wax; and waxes containing partially or fully deoxidized fatty acid esters such as deoxidized carnauba wax.

[Shell Layer]

Preferably, the shell layer 12 is composed mainly of a thermosetting resin. Preferably, the shell layer 12 is composed of a resin containing nitrogen atoms (e.g., amino groups) or a derivative thereof in order to enhance the strength, hardness, or cationic characteristic of the shell layer 12. The shell layer 12 containing nitrogen atoms is likely to be positively charged. Preferably, the shell layer 12 has a nitrogen atom content of 10% by mass or higher in order to enhance the cationic characteristic of the shell layer 12.

Preferably, the thermosetting resin for forming the shell layer 12 is a melamine resin, a urea resin, a sulfonamide resin, a glyoxal resin, a guanamine resin, an aniline resin, a polyimide resin, or a derivative of any of the aforementioned resins. The polyimide resin has nitrogen atoms in the polymer backbone. Accordingly, the shell layer 12 containing a polyimide resin is likely to be highly cationic. Suitable examples of the polyimide resin for forming the shell layer 12 include maleimide-based polymers and bismaleimide-based polymers (more specifically, aminobismaleimide polymers or bismaleimide-triazine polymers).

As the thermosetting resin for forming the shell layer 12, a resin produced through polycondensation of a compound having an amino group with an aldehyde (e.g., formaldehyde) is particularly preferable (hereinafter, referred to as aminoaldehyde resin). A melamine resin is a product of polycondensation of melamine with formaldehyde. A urea resin is a product of polycondensation of urea with formaldehyde. A glyoxal resin is a product of polycondensation of formaldehyde with a reaction product between glyoxal and urea.

The shell layer 12 has a thickness of preferably 1 nm or more and 20 nm or less, and more preferably 1 nm or more and 10 nm or less. Having a thickness of 20 nm or less, the shell layer 12 can be readily broken by heat and pressure applied when the toner is fixed to a recording medium. As a result, the binder resin 11*a* and the mold releasing agent contained in the core 11 quickly soften and melt. Thus, the toner can be fixed to the recording medium at a lower temperature. Having a thickness of 20 nm or less, furthermore, the shell layer 12 has not too high chargeability. As a result, image formation can be appropriately performed. Having a thickness of 1 nm or more, the shell layer 12 provides enhanced preservability to the toner. Specifically, the shell layer 12 has enough strength and therefore is less likely to be broken when the toner is subjected to impact (e.g., impact during transportation).

The thickness of the shell layer 12 can be measured by analyzing a TEM image of a cross section of the toner particle 10 using commercially available image analysis software (e.g., "WinROOF", product by Mitani Corporation).

Preferably, the shell layer 12 has a breaking portion (region having less mechanical strength). The breaking portion can be formed by generating a local defect in the shell layer 12. Having the breaking portion, the shell layer 12 can be readily broken by heat and pressure applied when the toner is fixed to a recording medium. As a result, the toner can be fixed to the recording medium at a lower temperature when the shell layer 12 is composed of a thermosetting resin. The number of the breaking portions may be optionally determined.

If the shell layer 12 has insufficient chargeability, a positive charge control agent may be added to the shell layer 12.

[External Additive]

The external additive 13 may be attached to the surface of the shell layer 12 as needed. The external additive 13 is used for the purpose of enhancing the fluidity or the handling characteristics of the toner. In order to enhance the fluidity or the handling characteristics of the toner, the amount of the external additive 13 to be added is preferably 0.5 parts by mass or more and 10 parts by mass or less, and more preferably 2 parts by mass or more and 5 parts by mass or less with respect to 100 parts by mass of the toner mother particles.

Suitable examples of the external additive 13 include silica and metal oxides (alumina, titanium oxide, magnesium oxide, zinc oxide, strontium titanate, or barium titanate). The external additives may be used independently, or two or more types of the external additives may be used in combination.

Preferably, the external additive 13 has a particle diameter of 0.01 μm or more and 1.0 μm or less in order to enhance the fluidity and the handling characteristics of the toner.

Next, a method for producing the toner according to the present embodiment will be described.

A method for producing a toner according to the present embodiment includes: dissolving a thermoplastic resin and a thermosetting resin in an organic solvent; mixing the organic solvent containing the thermoplastic resin and the thermosetting resin with an aqueous medium, and micronizing the thermoplastic resin in a mixture obtained; and forming a film of the dissolved thermosetting resin on surfaces of fine particles formed through the micronization.

Such a method for producing a toner does not require addition of the thermosetting resin at film formation, and therefore a toner having good quality can be produced in fewer steps. In addition, a toner having good quality can be produced at low cost.

[Examples]

Hereinafter, a method for preparing developers (two-component developers) A to X according to the present embodiment, a method for evaluating the same, and results of the evaluation will be described in sequence.

[Method for Preparing Developer A]

The developer A is a two-component developer composed of a toner and a carrier. The developer A was prepared by first preparing toner mother particles each composed of a core and a shell layer, and attaching an external additive to the resulting toner mother particles to prepare toner particles (eventually, toner). Then, the toner prepared is mixed with the carrier to complete the developer A. Hereinafter, a method for preparing the developer A will be described.

(Preparation of Toner Mother Particles)

The toner mother particles were prepared by first dissolving a thermoplastic resin (binder resin), an internal additive, and a thermosetting resin in an organic solvent. Specifically, 474 g of a polyester resin A, 36 g of a masterbatch (18 g of pigment blue 15:3 as a cyan pigment), 90 g of an ester wax, 4 mL of an aqueous solution of hexamethoxymethylolmelamine ("Mirben resin SM-607" having a solid concentration of 80% by mass, product by Showa Denko K. K.), and 900 g of tetrahydrofuran (THF) were put in a 5-L pressure-proof, round-bottom stainless steel container and heated to 50° C. Subsequently, the content of the container was stirred for 30 minutes to completely dissolve the solid components in the tetrahydrofuran (organic solvent). The polyester resin A, the pigment blue 15:3 as a cyan pigment, the ester wax, and the hexamethoxymethylolmelamine were a binder resin, a colorant, a mold releasing agent, and a material for forming the shell layer, respectively.

Physical properties and the like of the materials (the polyester resin A, the pigment blue 15:3 as a cyan pigment, and the ester wax) added to the tetrahydrofuran (organic solvent) were as follows.

The polyester resin A had an Mn of 2082, an Mw of 4861, an acid value (AV) of 22.4 mgKOH/g, a hydroxyl value (OHV) of 46.4 mgKOH/g, a Tm of 73.7° C., and a Tg of 34.6° C.

The pigment blue 15:3 as a cyan pigment was batched by being mixed and kneaded with the polyester resin A, and added to the container as a masterbatch. The masterbatch had a pigment content of 50% by mass.

The ester wax had an acid value (AV) of 0.1 mgKOH/g, a hydroxyl value (OHV) of 2.1 mgKOH/g, and a melting point of 76° C.

Subsequently, 6 g of an anionic surfactant ("Emal 0", product by Kao Corporation), 19.2 g of a 30% by mass sodium hydroxide aqueous solution, and 900 g of distilled water were put in a vessel (container) of a high-speed shear emulsification device ("Harmotec HMT-CA-2": CLEARMIX "CLM-2.25" equipped with ANCHOR MIXER "AM-0.2", product by M TECHNIQUE Co., Ltd.), and maintained at 50° C. for 30 minutes. Thus, the anionic surfactant and the sodium hydroxide (neutralizer) were dissolved in the distilled water.

Subsequently, the tetrahydrofuran solution was added to the vessel of the Harmotec. Subsequently, the content of the vessel was subjected to micronization by shear dispersion in the Harmotec at a CLEARMIX (rotor R1, screen S1.0-24) rotor rotational speed of 20000 rpm for 60 minutes. Thus, fine core particles containing the polyester resin A and so on were formed. The content of the vessel at the completion of the micronization had a pH (pH of the mixture) of 9.5 and a solution temperature (temperature of the mixture) of 47° C.

Subsequently, the content of the vessel was cooled to 20° C. at a rate of 5° C./minute. As a result, a dispersion A of fine resin particles was obtained as the content of the vessel. The fine resin particles in the dispersion A of fine resin particles had a median diameter (based on volume distribution) of 4.43 μm and a variation coefficient of 20.3%. The median diameter and the variation coefficient were measured using a laser diffraction/light scattering-type particle size distribution analyzer ("LA-920", product by HORIBA, Ltd.).

Subsequently, the dispersion A of fine resin particles were put in the pressure-proof, round-bottom stainless steel container, and the pH of the content of the container (pH of the mixture at the initiation of the film formation) was adjusted to 4 with hydrochloric acid under stirring at a rotational speed of 300 rpm. Subsequently, the content of the container was heated up to 85° C. at a rate of 1° C./minute, and the temperature of the content of the container was maintained at 85° C. for 3 hours. Thus, the hexamethoxymethylolmelamine in the container was reacted. As a result, a shell layer was formed on surfaces of the fine core particles. The content of the container at the completion of the reaction (film formation) had a pH (pH of the mixture) of 2.7 and a solution temperature (temperature of the mixture) of 82° C.

Subsequently, the content of the container was neutralized with sodium hydroxide so as to have a pH of 7. Subsequently, the content of the container was cooled to 20° C. at a rate of 5° C./minute. As a result, a toner mother particle-containing dispersion was obtained.

Subsequently, the resulting toner mother particle-containing dispersion was filtered by vacuum filtration (solid-liquid separation) using a Buchner funnel (Nutsche filter). The toner mother particles in the form of a wet cake collected through the filtration were dispersed again in ion exchanged water, and the resulting toner mother particle-containing dispersion was filtered again by vacuum filtration using a Buchner funnel. The dispersing and the filtering were repeated until the filtrate obtained through the filtering had an electrical conductivity of less than 3 μS/cm.

After the washing as described above, the toner mother particles were dried. In the preparation of the developer A, the toner mother particles collected from the dispersion were dried by being left to stand in an atmosphere at a temperature of 40° C. and an atmospheric pressure of 0.001 for 72 hours. Thus, toner mother particles having a median diameter (based on volume distribution) of 4.43 μm and a circularity of 0.965 were obtained.

(Preparation of External Additive)

One hundred grams (100 g) of dimethylpolysiloxane manufactured by Shin-Etsu Chemical Co., Ltd. and 100 g of 3-aminopropyltrimethoxy silane manufactured by Shin-Etsu Chemical Co., Ltd. were dissolved in 200 g of toluene, and the resulting solution was diluted tenfold.

The diluted solution of dimethylpolysiloxane and 3-aminopropyltrimethoxy silane were gradually added drop-wise to 200 g of fumed silica aerogel (BET specific surface area: 90 $m^2/g$) manufactured by Nippon Aerosil Co., Ltd. and mixed for 30 minutes under ultrasound irradiation and stiffing.

Subsequently, the resulting mixture was heated in an incubator at 150° C., and then toluene in the mixture was evaporated using a rotary evaporator to give a solid.

Subsequently, the resulting solid was dried using a reduced pressure dryer at a temperature set at 50° C. until the solid no longer lost weight. Further, the solid dried was heated in an electric furnace under a flow of nitrogen at 200° C. for 3 hours. Thus, a coarse powder was obtained.

Subsequently, the resulting coarse powder was broken up using a jet mill (IDS jet mill, product by Nippon Pneumatic Mfg. Co., Ltd.) and collected with a bag filter. As a result, a hydrophobic silica (external additive) was obtained.

(Preparation of Toner)

Using a 5-L mixing machine (FM mixer, product by Nippon Coke & Engineering Co., Ltd.), 200 g of the toner mother particles and 4 g of the external additive (hydrophobic fine silica particles) were mixed for 5 minutes. Subsequently, the mixture was screened using a 300-mesh screen (opening: 48 μm). Thus, a toner having a plurality of toner particles was obtained.

(Preparation of Carrier)

Thirty grams (30 g) of a polyamide-imide resin was diluted with 2 L of water. Subsequently, 120 g of a tetrafluoroethylene-hexafluoropropylene copolymer (FEP) was added to and dispersed in the resulting dilution of the resin, and then 3 g of silicon oxide was added thereto to be dispersed in the solution. Thus, a coat layer formation solution was obtained.

Subsequently, carrier particles were coated with the coat layer formation solution. Specifically, the coat layer formation solution prepared as described above and 10 kg of an uncoated ferrite carrier having an average particle diameter of 35 μm ("EF-35B", product by Powdertech Co., Ltd.) were put in a fluid bed coating machine to coat a surface of each carrier particle with a coat layer, and then baking was performed at 250° C. for 1 hour. Thus, a carrier having a plurality of carrier particles each coated with a coat layer was obtained.

(Mixing of Toner and Carrier)

Thirty grams (30 g) of the toner and 300 g of the carrier were put in a 500-mL plastic container (bottle) and mixed using a TURBULA shaker-mixer ("Type T2F", product by Shinmaru Enterprises Corporation) for 30 minutes. Thus, the developer A (two-component developer) was obtained.

[Method for Preparing Developer B]

The developer B was prepared in the same manner as in the preparation of the developer A except that the amounts of some materials were changed as follows.

For preparing a tetrahydrofuran solution (oil phase), 592.5 g of the polyester resin A, 45 g of the masterbatch (22.5 g of pigment blue 15:3 as a cyan pigment), 112.5 g of the ester wax, and 5 mL of the aqueous solution of hexamethoxymethylolmelamine ("Mirben resin SM-607" having a solid concentration of 80% by mass, product by Showa Denko K. K.) were put in 750 g of tetrahydrofuran to dissolve the hexamethoxymethylolmelamine. For preparing an aqueous solution (water phase), 6 g of the anionic surfactant and 24.1 g of the 30% by mass sodium hydroxide (neutralizer) were dissolved in 900 g of distilled water.

The content of the vessel at the completion of the micronization had a pH of 9.3 and a solution temperature of 46° C. in the preparation of the developer B. The content of the container at the completion of the reaction (film formation) had a pH of 2.7 and a solution temperature of 83° C.

[Method for Preparing Developer C]

The developer C was prepared in the same manner as in the preparation of the developer A except that the amounts of some materials were changed as follows.

For preparing a tetrahydrofuran solution (oil phase), 237 g of the polyester resin A, 18 g of the masterbatch (9.0 g of pigment blue 15:3 as a cyan pigment), 45 g of the ester wax, and 2 mL of the aqueous solution of hexamethoxymethylolmelamine ("Mirben resin SM-607" having a solid concentration of 80% by mass, product by Showa Denko K. K.) were put in 1200 g of tetrahydrofuran to dissolve the hexamethoxymethylolmelamine. For preparing an aqueous solution (water phase), 6 g of the anionic surfactant and 9.6 g of the 30% by mass sodium hydroxide (neutralizer) were dissolved in 900 g of distilled water.

The content of the vessel at the completion of the micronization had a pH of 9.1 and a solution temperature of 45° C. in the preparation of the developer C. The content of the container at the completion of the reaction (film formation) had a pH of 2.6 and a solution temperature of 82° C.

[Method for Preparing Developer D]

The developer D was prepared in the same manner as in the preparation of the developer A except that the amounts of some materials were changed as follows.

For preparing a tetrahydrofuran solution (oil phase), 177.8 g of the polyester resin A, 13.5 g of the masterbatch (6.75 g of pigment blue 15:3 as a cyan pigment), 33.8 g of the ester wax, and 1.5 mL of the aqueous solution of hexamethoxymethylolmelamine ("Mirben resin SM-607" having a solid concentration of 80% by mass, product by Showa Denko K. K.) were put in 1275 g of tetrahydrofuran to dissolve the hexamethoxymethylolmelamine. For preparing an aqueous solution (water phase), 6 g of the anionic surfactant and 7.2 g of the 30% by mass sodium hydroxide (neutralizer) were dissolved in 900 g of distilled water.

The content of the vessel at the completion of the micronization had a pH of 9.4 and a solution temperature of 48° C. in the preparation of the developer D. The content of the container at the completion of the reaction (film formation) had a pH of 2.6 and a solution temperature of 82° C.

[Method for Preparing Developer E]

The developer E was prepared in the same manner as in the preparation of the developer A except that the amounts of some materials were changed as follows.

For preparing a tetrahydrofuran solution (oil phase), 651.8 g of the polyester resin A, 49.5 g of the masterbatch (24.75 g of pigment blue 15:3 as a cyan pigment), 123.8 g of the ester wax, and 5.5 mL of the aqueous solution of hexamethoxymethylolmelamine ("Mirben resin SM-607" having a solid concentration of 80% by mass, product by Showa Denko K. K.) were put in 675 g of tetrahydrofuran to dissolve the hexamethoxymethylolmelamine. For preparing an aqueous solution (water phase), 6 g of the anionic surfactant and 26.5 g of the 30% by mass sodium hydroxide (neutralizer) were dissolved in 900 g of distilled water.

The content of the vessel at the completion of the micronization had a pH of 9.4 and a solution temperature of 48° C. in the preparation of the developer E. The content of the container at the completion of the reaction (film formation) had a pH of 2.6 and a solution temperature of 82° C.

[Method for Preparing Developer F]

The developer F was prepared in the same manner as in the preparation of the developer A except that the amounts of some materials were changed as follows.

For preparing a tetrahydrofuran solution (oil phase), 592.5 g of the polyester resin A, 45.0 g of the masterbatch (22.5 g of pigment blue 15:3 as a cyan pigment), 112.5 g of the ester wax, and 5.0 mL of the aqueous solution of hexamethoxymethylolmelamine ("Mirben resin SM-607" having a solid concentration of 80% by mass, product by Showa Denko K. K.) were put in 750 g of tetrahydrofuran to dissolve the hexamethoxymethylolmelamine. For preparing an aqueous solution (water phase), 6 g of the anionic surfactant and 24.1 g of the 30% by mass sodium hydroxide (neutralizer) were dissolved in 900 g of distilled water.

The content of the vessel at the completion of the micronization had a pH of 9.3 and a solution temperature of 47° C. in the preparation of the developer F. The content of the container at the completion of the reaction (film formation) had a pH of 2.7 and a solution temperature of 83° C.

[Method for Preparing Developer G]

The developer G was prepared in the same manner as in the preparation of the developer A except that a styrene-acrylic resin was used instead of the polyester resin A.

The styrene-acrylic resin had an Mn of 13700, an Mw of 3980, an acid value (AV) of 5.02 mgKOH/g, a Tm of 81.5° C., and a Tg of 32.3° C.

The content of the vessel at the completion of the micronization had a pH of 9.0 and a solution temperature of 45° C. in the preparation of the developer G. The content of the container at the completion of the reaction (film formation) had a pH of 2.6 and a solution temperature of 81° C.

[Method for Preparing Developer H]

The developer H was prepared in the same manner as in the preparation of the developer B except that 2-butanone was used instead of tetrahydrofuran.

The content of the vessel at the completion of the micronization had a pH of 9.3 and a solution temperature of 44° C. in the preparation of the developer H. The content of the container at the completion of the reaction (film formation) had a pH of 2.7 and a solution temperature of 84° C.

[Method for Preparing Developer I]

The developer I was prepared in the same manner as in the preparation of the developer B except that ethyl acetate was used instead of tetrahydrofuran.

The content of the vessel at the completion of the micronization had a pH of 9.3 and a solution temperature of 47° C. in the preparation of the developer I. The content of the container at the completion of the reaction (film formation) had a pH of 2.6 and a solution temperature of 83° C.

[Method for Preparing Developer J]

The developer J was prepared in the same manner as in the preparation of the developer A except that the types and the amounts of some materials were changed as follows.

For preparing a tetrahydrofuran solution (oil phase), 474 g of the polyester resin A, 36 g of the masterbatch (18 g of pigment blue 15:3 as a cyan pigment), 90 g of the ester wax, and 1.5 mL of an aqueous solution of dimethoxymethyl urea (solid concentration: 80% by mass) were put in 900 g of tetrahydrofuran to dissolve the dimethoxymethyl urea.

The content of the vessel at the completion of the micronization had a pH of 9.2 and a solution temperature of 48° C. in the preparation of the developer J. The content of the container at the completion of the reaction (film formation) had a pH of 2.7 and a solution temperature of 82° C.

[Method for Preparing Developer K]

The developer K was prepared in the same manner as in the preparation of the developer A except that the amounts of some materials were changed as follows.

For preparing an aqueous solution (water phase), 6 g of the anionic surfactant and 9.6 g of the 30% by mass sodium hydroxide (neutralizer) were dissolved in 900 g of distilled water.

The content of the vessel at the completion of the micronization had a pH of 8.6 and a solution temperature of 48° C. in the preparation of the developer K. The content of the container at the completion of the reaction (film formation) had a pH of 2.6 and a solution temperature of 82° C.

[Method for Preparing Developer L]

The developer L was prepared in the same manner as in the preparation of the developer A except that the temperature at the initiation of the micronization was changed from 50° C. to 55° C.

The content of the vessel at the completion of the micronization had a pH of 9.1 and a solution temperature of 53° C. in the preparation of the developer L. The content of the container at the completion of the reaction (film formation) had a pH of 2.8 and a solution temperature of 81° C.

[Method for Preparing Developer M]

The developer M was prepared in the same manner as in the preparation of the developer A except that the temperature at the initiation of the film formation was changed from 85° C. to 75° C.

The content of the vessel at the completion of the micronization had a pH of 9.2 and a solution temperature of 47° C. in the preparation of the developer M. The content of the container at the completion of the reaction (film formation) had a pH of 2.8 and a solution temperature of 72° C.

[Method for Preparing Developer N]

The developer N was prepared in the same manner as in the preparation of the developer A except that the pH of the content of the container at the initiation of the reaction (film formation) was changed from 4.0 to 4.5, and the pH of the content of the container at the completion of the reaction (film formation) was changed from 2.7 to 3.3.

The content of the vessel at the completion of the micronization had a pH of 9.4 and a solution temperature of 48° C. in the preparation of the developer N. The content of the container at the completion of the reaction (film formation) had a pH of 3.3 and a solution temperature of 83° C.

[Method for Preparing Developer O]

The developer 0 was prepared in the same manner as in the preparation of the developer A except that the polyester resin B was used instead of the polyester resin A.

The polyester resin B had an Mn of 1191, an Mw of 2291, an acid value (AV) of 11.9 mgKOH/g, a hydroxyl value (OHV) of 37.6 mgKOH/g, a Tm of 70.8° C., and a Tg of 38.4° C.

The content of the vessel at the completion of the micronization had a pH of 9.2 and a solution temperature of 46° C. in the preparation of the developer 0. The content of the container at the completion of the reaction (film formation) had a pH of 2.8 and a solution temperature of 81° C.

[Method for Preparing Developer P]

The developer P was prepared in the same manner as in the preparation of the developer A except that the amounts of some materials were changed as follows.

For preparing a tetrahydrofuran solution (oil phase), 118.5 g of the polyester resin A, 9 g of the masterbatch (4.5 g of pigment blue 15:3 as a cyan pigment), 22.5 g of the ester wax, and 1 mL of the aqueous solution of hexamethoxymethylolmelamine ("Mirben resin SM-607" having a solid concentration of 80% by mass, product by Showa Denko K. K.) were put in 1350 g of tetrahydrofuran to dissolve the hexamethoxymethylolmelamine. For preparing an aqueous solution (water phase), 6 g of the anionic surfactant and 4.8 g of the 30% by mass sodium hydroxide (neutralizer) were dissolved in 900 g of distilled water.

The content of the vessel at the completion of the micronization had a pH of 9.3 and a solution temperature of 47° C. in the preparation of the developer P. The content of the container at the completion of the reaction (film formation) had a pH of 2.7 and a solution temperature of 84° C.

[Method for Preparing Developer Q]

The developer Q was prepared in the same manner as in the preparation of the developer A except that the amounts of some materials were changed as follows.

For preparing a tetrahydrofuran solution (oil phase), 711 g of the polyester resin A, 54 g of the masterbatch (27 g of pigment blue 15:3 as a cyan pigment), 135 g of the ester wax, and 6 mL of the aqueous solution of hexamethoxymethylolmelamine ("Mirben resin SM-607" having a solid concentration of 80% by mass, product by Showa Denko K. K.) were put in 600 g of tetrahydrofuran to dissolve the hexamethoxymethylolmelamine. For preparing an aqueous solution (water phase), 6 g of the anionic surfactant and 28.9 g of the 30% by mass sodium hydroxide (neutralizer) were dissolved in 900 g of distilled water.

The content of the vessel at the completion of the micronization had a pH of 9.3 and a solution temperature of 48° C. in the preparation of the developer Q. The content of the container at the completion of the reaction (film formation) had a pH of 2.7 and a solution temperature of 82° C.

[Method for Preparing Developer R]

The developer R was prepared in the same manner as in the preparation of the developer A except that the polyester resin C was used instead of the polyester resin A.

The polyester resin C had an Mn of 2213, an Mw of 5920, an acid value (AV) of 8.4 mgKOH/g, a hydroxyl value (OHV) of 54.0 mgKOH/g, a Tm of 69.9° C., and a Tg of 37.4° C.

The content of the vessel at the completion of the micronization had a pH of 9.1 and a solution temperature of 47° C. in the preparation of the developer R. The content of the container at the completion of the reaction (film formation) had a pH of 2.8 and a solution temperature of 83° C.

[Method for Preparing Developer S]

The developer S was prepared in the same manner as in the preparation of the developer A except that the film formation (formation of the shell layer) was omitted. In the preparation of the developer S, hexamethoxymethylolmelamine was not used. In addition, in the preparation of the developer S, the heating after the micronization was not performed since the formation of the film of the thermosetting resin was omitted.

The content of the vessel at the completion of the micronization had a pH of 9.3 and a solution temperature of 46° C. in the preparation of the developer S.

[Method for Preparing Developer T]

The developer T was prepared in the same manner as in the preparation of the developer A except that the amounts of some materials were changed as follows.

For preparing a tetrahydrofuran solution (oil phase), 474 g of the polyester resin A, 36 g of the masterbatch (18 g of pigment blue 15:3 as a cyan pigment), 90 g of the ester wax, and 12 mL of the aqueous solution of hexamethoxymethylolmelamine ("Mirben resin SM-607" having a solid concentration of 80% by mass, product by Showa Denko K. K.) were put in 900 g of tetrahydrofuran to dissolve the hexamethoxymethylolmelamine.

The content of the vessel at the completion of the micronization had a pH of 9.4 and a solution temperature of 45° C. in the preparation of the developer T. The content of the container at the completion of the reaction (film formation) had a pH of 2.6 and a solution temperature of 82° C.

[Method for Preparing Developer U]

The developer U was prepared in the same manner as in the preparation of the developer A except that the amounts of some materials were changed as follows.

For preparing an aqueous solution (water phase), 6 g of the anionic surfactant and 4.8 g of the 30% by mass sodium hydroxide (neutralizer) were dissolved in 900 g of distilled water.

The content of the vessel at the completion of the micronization had a pH of 7.6 and a solution temperature of 48° C. in the preparation of the developer U. The content of the container at the completion of the reaction (film formation) had a pH of 2.6 and a solution temperature of 83° C.

[Method for Preparing Developer V]

The developer V was prepared in the same manner as in the preparation of the developer A except that the temperature at the initiation of the micronization was changed from 50° C. to 65° C.

The content of the vessel at the completion of the micronization had a pH of 9.0 and a solution temperature of 63° C. in the preparation of the developer V. The content of the container at the completion of the reaction (film formation) had a pH of 2.7 and a solution temperature of 82° C.

[Method for Preparing Developer W]

The developer W was prepared in the same manner as in the preparation of the developer A except that the temperature at the initiation of the film formation was changed from 85° C. to 70° C.

The content of the vessel at the completion of the micronization had a pH of 9.2 and a solution temperature of 47° C. in the preparation of the developer W. The content of the container at the completion of the reaction (film formation) had a pH of 2.5 and a solution temperature of 73° C.

[Method for Preparing Developer X]

The developer X was prepared in the same manner as in the preparation of the developer A except that the pH of the content of the container at the initiation of the reaction (film formation) was changed from 4.0 to 5.0, and the pH of the content of the container at the completion of the reaction (film formation) was changed from 2.7 to 3.9.

The content of the vessel at the completion of the micronization had a pH of 9.3 and a solution temperature of 46° C. in the preparation of the developer X. The content of the container at the completion of the reaction (film formation) had a pH of 3.9 and a solution temperature of 82° C.

[Evaluation Methods]

Samples were evaluated as follows.

(Particle Diameter)

The median diameter (based on volume distribution) was measured using a laser diffraction/light scattering-type particle size distribution analyzer ("LA-950V2", product by HORIBA, Ltd.)

(High-Temperature Preservability)

Three grams (3 g) of each toner obtained was put in a 30-mL plastic container (bottle). Subsequently, the container containing the toner was placed in an incubator (oven) set at 60° C. and allowed to stand for 3 hours. After 3 hours had passed, the container was taken out and allowed to stand in an environment at a temperature of 25° C. and a humidity of 65% for 3 hours to give an evaluation toner.

A screen C (opening: 45 μm), a screen B (opening: 63 μm), and a screen A (opening: 105 μm) were stacked in this order on a powder tester (product by Hosokawa Micron Corporation). The evaluation toner was placed on the screen A, and the screens were oscillated for 30 seconds at oscillation strength setting 5, and then the mass (g) of the toner remaining on each screen was measured. Then, a degree of aggregation (% by mass) was calculated according to the following equations.

$$\text{Proportion } A = (\text{mass of toner remaining on screen } A) \times 100/3 [\%\text{ by mass}] \quad \text{Equation 1:}$$

$$\text{Proportion } B = (\text{mass of toner remaining on screen } B) \times 100/3 [\%\text{ by mass}] \quad \text{Equation 2:}$$

$$\text{Proportion } C = (\text{mass of toner remaining on screen } C) \times 100/3 [\%\text{ by mass}] \quad \text{Equation 3:}$$

$$\text{Degree of aggregation} = \text{Proportion } A + \text{Proportion } B \times 3/5 + \text{Proportion } C \times 1/5 [\%\text{ by mass}] \quad \text{Equation 4:}$$

In the evaluation of the high-temperature preservability, a degree of aggregation of lower than 2% by mass was determined to be very good (VG), a degree of aggregation of 2% by mass or higher and lower than 15% by mass was determined to be good (G), and a degree of aggregation of 15% by mass or higher was determined to be poor (P).

(Fixability)

A printer ("TASKalfa 5550ci", product by KYOCERA Document Solutions Inc.) provided with a fixing device (fixing jig) modified to allow adjustment of the fixing temperature was used as an evaluation apparatus. Each developer obtained was put in a developing device of the evaluation apparatus, and each toner obtained was put in a toner container of the evaluation apparatus. Then, paper was conveyed at a linear velocity of 266 mm/second in the evaluation apparatus, and a toner image of 0.4 mg/cm$^2$ was transferred to the paper being conveyed ("Color Copy 90", product by Mondi). Then, a temperature range (non-offset range) in which neither cold offset nor hot offset occurred was measured while the fixing temperature of the fixing device was gradually raised. Specifically, it was determined that offset occurred when the toner was found by visual observation to be adhering to the fixing roller of the evaluation apparatus.

In the evaluation of the fixability, a non-offset range of 40° C. or higher was determined to be good (G), and a non-offset range of lower than 40° C. was determined to be poor (P).

In the evaluation of the developing properties, a ratio of the detached toner amount of 85% by mass or higher was determined to be very good (VG), a ratio of the detached toner amount of 80% by mass or higher and lower than 85% by mass was determined to be good (G), and a ratio of the detached toner amount of lower than 80% by mass was determined to be poor (P).

[Evaluation Result]

Tables 1 to 4 collectively show results of the developers A to X evaluated. In Table 1, the concentrations of the thermoplastic resin (including the thermoplastic resin in the masterbatch), the wax and the pigment, and the thermosetting resin are each shown as a ratio (% by mass) thereof to the total amount of the thermoplastic resin, the wax, the pigment, and the organic solvent.

TABLE 1

| | Oil phase | | | | | | |
|---|---|---|---|---|---|---|---|
| | Thermoplastic resin | | | Wax, pigment | Thermosetting resin | | |
| Developer | Resin | Acid value [mgKOH/g] | Concentration [wt %] | concentration [wt %] | Resin | Concentration [wt %] | Organic solvent |
| A | PES resin A | 22 | 32.8 | 7.2 | Melamine | 0.27 | THF |
| B | | | 41.0 | 9.0 | | 0.33 | |
| C | | | 16.4 | 3.6 | | 0.13 | |
| D | | | 12.3 | 2.7 | | | |
| E | | | 45.1 | 9.9 | | | |
| F | | | 41.0 | 9.0 | | | |
| G | St/Ac resin | 5 | 32.8 | 7.2 | Melamine | 0.27 | THF |
| H | PES resin A | 22 | 41.0 | 9.0 | | 0.33 | 2-butanone |
| I | | 22 | 41.0 | 9.0 | | 0.33 | Ethyl acetate |
| J | PES resin A | 22 | 32.8 | 7.2 | Urea | 0.27 | THF |
| K | | | 32.8 | 7.2 | Melamine | 0.27 | |
| L | | | 32.8 | 7.2 | | 0.27 | |
| M | | | 32.8 | 7.2 | | 0.27 | |
| N | | | 32.8 | 7.2 | | 0.27 | |
| O | PES resin B | 12 | 32.8 | 7.2 | Melamine | 0.27 | |
| P | PES resin A | 22 | 8.2 | 1.8 | | 0.07 | |
| Q | | 22 | 49.2 | 10.8 | | 0.40 | |
| R | PES resin C | 8 | 32.8 | 7.2 | | 0.27 | |
| S | PES resin A | 22 | 32.8 | 7.2 | — | — | |
| T | | | 32.8 | 7.2 | Melamine | 0.80 | |
| U | | | 32.8 | 7.2 | | 0.27 | |
| V | | | 32.8 | 7.2 | | 0.27 | |
| W | | | 32.8 | 7.2 | | 0.27 | |
| X | | | 32.8 | 7.2 | | 0.27 | |

(Developing Properties)

The electric field responsiveness of each toner obtained was evaluated using a toner separating jig including a roller having an evenly split sextupole magnet (40 mT) on the inside and an electrode opposed to the roller. Specifically, a uniform layer of 0.3 g of the toner was formed on the roller. Then, the roller was rotated, and a bias (DC, +3 kV) was applied to the roller, whereupon a change in the charge amount on the electrode was measured. On the assumption that the charge amount of the toner is constant, the change in the charge amount measured represents the amount of toner contributing to the development. A ratio of the change in the charge amount in one second after the initiation of the bias application to the saturated charge amount (change in charge amount in one second after initiation of bias application/saturated charge amount) was calculated thereby to determine a ratio of the amount of toner detached in one second to the saturated amount of the toner (hereinafter, referred to as ratio of the detached toner amount). In this method, the application of the bias to the roller causes the toner particles on the roller to move, causing a change in the charge amount on the electrode.

TABLE 2

| | Water phase | | | Initiation of micronization | Initiation of film formation |
|---|---|---|---|---|---|
| Developer | Water (g) | Surfactant (g) | NaOH (g) | Temperature (° C.) | Temperature (° C.) |
| A | 900 | 6 | 19.2 | 50 | 85 |
| B | | | | | |
| C | | | | | |
| D | | | | | |
| E | | | | | |
| F | | | | | |
| G | | | | | |
| H | | | | | |
| I | | | | | |
| J | | | | | |
| K | 900 | 6 | 9.6 | | |
| L | 900 | 6 | 19.2 | 55 | 85 |
| M | 900 | 6 | 19.2 | 50 | 75 |
| N | 900 | 6 | 19.2 | 50 | 85 |
| O | | | | | |

TABLE 2-continued

| Developer | Water phase Water (g) | Surfactant (g) | NaOH (g) | Initiation of micronization Temperature (° C.) | Initiation of film formation Temperature (° C.) |
|---|---|---|---|---|---|
| P | 900 | 6 | 4.8 | | |
| Q | 900 | 6 | 28.9 | | |
| R | 900 | 6 | 19.2 | | |
| S | 900 | 6 | 19.2 | 50 | — |
| T | 900 | 6 | 19.2 | 50 | 85 |
| U | 900 | 6 | 4.8 | 50 | 85 |
| V | 900 | 6 | 19.2 | 65 | 85 |
| W | | | | 50 | 70 |
| X | | | | 50 | 85 |

TABLE 3

| Developer | Completion of micronization Temperature [° C.] | pH | Completion of film formation Temperature [° C.] | pH |
|---|---|---|---|---|
| A | 47 | 9.5 | 82 | 2.7 |
| B | 46 | 9.3 | 83 | 2.7 |
| C | 45 | 9.1 | 82 | 2.6 |
| D | 48 | 9.4 | 82 | 2.6 |
| E | 48 | 9.4 | 82 | 2.6 |
| F | 47 | 9.3 | 83 | 2.7 |
| G | 45 | 9.0 | 81 | 2.6 |
| H | 44 | 9.3 | 84 | 2.7 |
| I | 47 | 9.3 | 83 | 2.6 |
| J | 48 | 9.2 | 82 | 2.7 |
| K | 48 | 8.6 | 82 | 2.6 |
| L | 53 | 9.1 | 81 | 2.8 |
| M | 47 | 9.2 | 72 | 2.8 |
| N | 48 | 9.4 | 83 | 3.3 |
| O | 46 | 9.2 | 81 | 2.8 |
| P | 47 | 9.3 | 84 | 2.7 |
| Q | 48 | 9.3 | 82 | 2.7 |
| R | 47 | 9.1 | 83 | 2.8 |
| S | 46 | 9.3 | — | — |
| T | 45 | 9.4 | 82 | 2.6 |
| U | 48 | 7.6 | 83 | 2.6 |
| V | 63 | 9.0 | 82 | 2.7 |
| W | 47 | 9.2 | 73 | 2.5 |
| X | 46 | 9.3 | 82 | 3.9 |

TABLE 4

| Developer | Particle diameter [μm] | Preservability Degree of aggregation [wt %] | Fixability Non-offset range [° C.] | Developing properties Detatched toner amount [wt %] |
|---|---|---|---|---|
| A | 4.63 | 1.5 | 95-155 | 87.3 |
| B | 4.56 | 0.8 | 100-160 | 87.9 |
| C | 4.02 | 1.7 | 100-155 | 88.7 |
| D | 3.89 | 1.8 | 105-145 | 85.2 |
| E | 4.98 | 0.1 | 105-155 | 87.5 |
| F | 4.58 | 0.3 | 115-165 | 91.7 |
| G | 4.64 | 1.7 | 110-155 | 89.8 |
| H | 4.55 | 1.3 | 95-150 | 88.5 |
| I | 4.62 | 1.6 | 95-155 | 87.3 |
| J | 4.54 | 1.2 | 105-150 | 85.2 |
| K | 5.32 | 1.9 | 105-155 | 83.9 |
| L | 4.63 | 2.9 | 100-130 | 83.3 |
| M | 4.52 | 2.7 | 105-155 | 85.2 |
| N | 4.78 | 2.6 | 100-160 | 85.7 |
| O | 5.25 | 1.0 | 105-155 | 82.6 |
| P | 2.75 | 84.3 | 100-130 | 36.3 |
| Q | 6.77 | 0.1 | 105-160 | — |
| R | 9.45 | 0.2 | 110-135 | — |

TABLE 4-continued

| Developer | Particle diameter [μm] | Preservability Degree of aggregation [wt %] | Fixability Non-offset range [° C.] | Developing properties Detatched toner amount [wt %] |
|---|---|---|---|---|
| S | 4.59 | 93.3 | 85-175 | 57.6 |
| T | 4.62 | 0.2 | 125-160 | 92.1 |
| U | 9.27 | 92.1 | 100-150 | — |
| V | 4.48 | 95.7 | 105-135 | 61.1 |
| W | 4.53 | 14.6 | 95-150 | 79.8 |
| X | 4.61 | 8.1 | 100-140 | 81.4 |

(Particle Diameter)

The developer A had a median diameter (based on volume distribution) of 4.63 μm; the developer B, 4.56 μm; the developer C, 4.02 μm; the developer D, 3.89 μm; the developer E, 4.98 μm; the developer F, 4.58 μm; the developer G, 4.64 μm; the developer H, 4.55 μm; the developer I, 4.62 μm; the developer J, 4.54 μm; the developer K, 5.32 μm; the developer L, 4.63 μm; the developer M, 4.52 μm; the developer N, 4.78 μm; the developer 0, 5.25 μm; the developer P, 2.75 μm; the developer Q, 6.77 μm; the developer R, 9.45 μm; the developer S, 4.59 μm; the developer T, 4.62 μm; the developer U, 9.27 μm; the developer V, 4.48 μm; the developer W, 4.53 μm; and the developer X, 4.61 μm.

(Preservability)

The developers A to K, 0, Q, R, and T each had a degree of aggregation of lower than 2% by mass. The developers L, M, N, W, and X each had a degree of aggregation of 2% by mass or higher and lower than 15% by mass. The developers P, S, U, and V each had a degree of aggregation of 15% by mass or higher.

(Fixability)

The developers A to K, M, N, O, Q, S, U, W, and X each had a width of non-offset range (difference between the highest temperature and the lowest temperature) of 40° C. or more. The developers L, P, R, T, and V each had a width of non-offset range of less than 40° C.

(Developing Properties)

The developers A to J, M, N, and T each had a ratio of the detached toner amount of 85% by mass or higher. The developers K, L, 0, and X each had a ratio of the detached toner amount of 80% by mass or higher and lower than 85% by mass. The developers P, S, V, and W each had a ratio of the detached toner amount of lower than 80% by mass. The developers Q, R, and U were unmeasurable as having too large particle size distribution.

As described above, the methods for preparing the developers A to R and T to X relate to production of a toner and include: dissolving a thermoplastic resin and a thermosetting resin in an organic solvent; mixing the organic solvent containing the thermoplastic resin and the thermosetting resin with an aqueous medium, and micronizing the thermoplastic resin in a mixture obtained; and forming a film of the dissolved thermosetting resin on surfaces of fine particles formed through the micronization. More specifically, the shell layer was formed by preliminary dissolving the thermoplastic resin and the thermosetting resin in the organic solvent to produce fine core particles (micronize the thermoplastic resin) under a stable condition, and then establishing a condition that causes the thermosetting resin to adsorb onto the surfaces of the fine particles and go through a polymerization reaction (film formation reaction) while removing the solvent by evaporation.

Such a method for producing a toner does not require addition of the thermosetting resin at the film formation, simplifying the production process. As indicated by Tables 1 to 4, such a production method can be applied to production of various types of toners.

The methods for preparing the developers A to R and T to X are to produce a toner by a chemical method. More specifically, a particle of the core (e.g., a binder resin containing a colorant, a charge control agent, and/or a wax) of each toner particle is formed from a fine particle by polymerizing monomers or growing a polymer particle. The chemical method is advantageous in energy saving and environmental protection, and capable of forming particles with less energy than pulverization. In addition, the chemical method is performed in the presence of a dispersion medium and therefore makes it easier to handle a low-melting resin. Furthermore, the chemical method makes it easier to design particles of the toner being produced so that they have such a shape, size, composition, or the like as to have best functionality.

As shown in Table 4, the methods for preparing the developers A to R and T to X each give a toner excellent both in the fixability and in the preservability by coating a low melt viscosity thermoplastic resin with a hard thermosetting resin. In addition, the methods can form the shell layer in a stable manner and therefore prevent separation (peel-off) of the shell layer. Furthermore, use of such a toner in an electrophotographic apparatus can allow an electrophotographic image to have image quality nearly as good as image quality achieved by silver halide photography or printing.

As shown in Table 3, in the methods for preparing the developers A to R and T to X, the pH (pH of the mixture) in the film formation was adjusted to be smaller than the pH (pH of the mixture) in the micronization. Specifically, the pH in the film formation was adjusted to be smaller than the pH in the micronization by 5 or more. By adjusting the pH in the micronization and the pH in the film formation, it is possible to accelerate the micronization while preventing the formation of the film of the thermosetting resin during the micronization, and further to favorably form the film of the thermosetting resin on the surfaces of the resulting fine particles after the micronization.

As shown in Tables 2 and 3, in the methods for preparing the developers A to R and T to X, the temperature (temperature of the mixture) in the film formation was adjusted to be higher than the temperature (temperature of the mixture) in the micronization. The temperature in the film formation was adjusted to be higher than the temperature in the micronization by 30° C. or higher for the most of the developers A to R and T to X. By adjusting the temperature in the micronization and the temperature in the film formation, it is possible to accelerate the micronization while preventing the formation of the film of the thermosetting resin during the micronization, and further to favorably coat the surfaces of the resulting fine particles with the thermosetting resin after the micronization.

As shown in Table 3, in the methods for preparing the developers A to J, L to T, and V to X, the pH (pH of the mixture) at the completion of the micronization was 9.0 or higher. The pH of the mixture tends to decrease with the advance of the micronization. As long as the pH at the completion of the micronization is 9.0 or higher, therefore, the pH in the micronization is expected to be 9.0 or higher. When the pH in the micronization is 9.0 or higher, the acid groups of the thermoplastic resin can be readily dissociated to accelerate the micronization. As a result, enhancement of the developing properties can be facilitated.

As shown in Tables 2 and 3, in the methods for preparing the developers A to K, M to U, W, and X, the temperature (temperature of the mixture) in the micronization was 50° C. or lower. At a temperature of 50° C. or lower in the micronization, the solvent is less likely to vaporize. Accordingly, the solubility of the thermosetting resin in the solvent is kept high, and the possibility of the formation of the film of the thermosetting resin, which is unwanted during the micronization, is reduced. As a result, the film of the thermosetting resin can be favorably formed in the film formation. The solution temperature tends to decrease with the advance of the micronization.

As shown in Table 3, in the methods for preparing the developers A to X, the pH (pH of the mixture) at the completion of the reaction (film formation) was 4 or lower. A pH of 4 or lower at the completion of the reaction (film formation) facilitates the formation of the film or the polymerization reaction of the thermosetting resin. The pH tends to decrease with the advance of the reaction (film formation).

As shown in Tables 2 and 3, in the methods for preparing the developers A to L, N to R, T to V, and X, the temperature (temperature of the mixture) in the film formation was 75° C. or higher. A temperature of 75° C. or higher in the film formation facilitates the formation of the film or the polymerization reaction of the thermosetting resin. The solution temperature tends to decrease with the advance of the reaction (film formation).

As shown in Table 1, in the methods for preparing the developers A to F, H to N, P, Q, and S to X, the thermoplastic resin was a polyester resin having an acid value of 20 mgKOH/g or higher. Having an acid value of 20 mgKOH/g or higher, the thermoplastic resin used is expected to be micronized in an accelerated manner. As a result, enhancement of the developing properties and the like of the developers is expected to be facilitated. In order to have appropriate viscosity, the thermoplastic resin is preferably a polyester resin having an acid value of 20 mgKOH/g or higher and 70 mgKOH/g or lower.

In the methods for preparing the developers A to R and T to X, the thermosetting resin was a melamine resin or a urea resin. Such a thermosetting resin is likely to provide a developer having excellent preservability.

In the methods for preparing the developers A to R and T to X, the organic solvent was 2-butanone (ethyl methyl ketone), tetrahydrofuran, or ethyl acetate. Such an organic solvent is preferred in order to favorably micronize the thermoplastic resin and form the film of the thermosetting resin.

As shown in Table 1, in the methods for preparing the developers A to 0 and R to X, the thermoplastic resin was dissolved in the organic solvent such that the concentration of the thermoplastic resin would be in the range of 10% by mass or higher and 48% by mass or lower. Such preparation methods are expected to accelerate the micronization. As a result, enhancement of the developing properties of the developers is expected to be facilitated.

The present disclosure is not limited to the above-described embodiment. A toner having good quality can be produced in fewer steps as long as the method for producing the toner includes at least: dissolving a thermoplastic resin and a thermosetting resin in an organic solvent; mixing the organic solvent containing the thermoplastic resin and the thermosetting resin with an aqueous medium, and micronizing the thermoplastic resin in a mixture obtained; and forming a film of the dissolved thermosetting resin on surfaces of fine particles formed through the micronization, because the method does not require addition of the thermosetting resin at the film formation. In addition, a toner having good quality can be produced at low cost.

What is claimed is:

1. A method for producing a toner, comprising:

dissolving a thermoplastic resin and a thermosetting resin in an organic solvent;

mixing the organic solvent containing the thermoplastic resin and the thermosetting resin with an aqueous medium, and micronizing the thermoplastic resin in a mixture obtained; and forming a film of the dissolved thermosetting resin on surfaces of fine particles formed through the micronizing.

2. A method according to claim 1, wherein the mixture has a smaller pH in the forming the film than in the micronizing.

3. A method according to claim 1, wherein the mixture has a higher temperature in the forming the film than in the micronizing.

4. A method according to claim 1, wherein the mixture has a pH of 9.0 or higher at completion of the micronizing.

5. A method according to claim 1, wherein the mixture has a temperature of 50° C. or lower in the micronizing.

6. A method according to claim 1, wherein the mixture has a pH of 4 or lower at completion of the forming the film.

7. A method according to claim 1, wherein the mixture has a temperature of 75° C. or higher in the forming the film.

8. A method according to claim 1, wherein the thermosetting resin is a melamine resin or a urea resin.

9. A method according to claim 1, wherein the organic solvent is ethyl methyl ketone, tetrahydrofuran, or ethyl acetate.

10. A method according to claim 1, wherein the thermoplastic resin is dissolved in the organic solvent such that the concentration of the thermoplastic resin is in a range of 10% by mass or higher and 48% by mass or lower.

* * * * *